US006418706B1

(12) United States Patent
Kit

(10) Patent No.: US 6,418,706 B1
(45) Date of Patent: Jul. 16, 2002

(54) WATCHBAND LINK ASSEMBLY

(75) Inventor: Ho Kwok Kit, Hong Kong (CN)

(73) Assignee: Fossil, Inc., Richardson, TX (US)

( * ) Notice: Subject to any disclaimer, the term of this patent is extended or adjusted under 35 U.S.C. 154(b) by 0 days.

(21) Appl. No.: 09/994,026

(22) Filed: Nov. 27, 2001

(51) Int. Cl.[7] ..... F16G 15/04
(52) U.S. Cl. ..... 59/80; 59/82; 59/85; 63/4
(58) Field of Search ..... 59/78, 80, 82, 59/84, 85, 93; 63/4

(56) References Cited

U.S. PATENT DOCUMENTS

| | | | | | |
|---|---|---|---|---|---|
| 1,496,298 | A | * | 6/1924 | Chapman | 59/78 |
| 3,363,745 | A | * | 1/1968 | Thuerman et al. | 59/78 |
| 3,837,163 | A | * | 9/1974 | Fujimori | 59/80 |
| 4,089,161 | A | * | 5/1978 | Aoki | 59/80 |
| 4,269,026 | A | * | 5/1981 | Bulle et al. | 59/82 |
| 4,770,008 | A | | 9/1988 | Yamaura | |
| 4,823,562 | A | | 4/1989 | Yokote et al. | |
| 6,053,630 | A | | 4/2000 | Polansky et al. | |
| 6,098,394 | A | * | 8/2000 | Hashimoto et al. | 59/80 |
| 6,237,319 | B1 | | 5/2001 | Amundsen et al. | |
| 6,298,650 | B1 | | 10/2001 | Amundsen et al. | |

* cited by examiner

*Primary Examiner*—David Jones
(74) *Attorney, Agent, or Firm*—Locke Liddell & Sapp LLP

(57) ABSTRACT

A link assembly for a band comprising a first segment pivotably connected to a second segment by a connecting pin. Each segment contains an extension portion and a receiver portion. The receiver portion includes a receiving area defined by two spaced apart parallel arms, with each arm having a co-axially aligned opening. The extension portion is appropriately sized to fit between the spaced apart parallel arms. The extension portion contains a transverse opening that is co-axially aligned with the parallel arm openings. A spring tube is inserted inside the transverse opening to provide a locking mechanism to prevent the pin from disengaging from the link assembly.

18 Claims, 2 Drawing Sheets

WATCHBAND LINK ASSEMBLY

TECHNICAL FIELD OF THE INVENTION

The present invention relates to a link assembly for items of jewelry such as for example, a bracelet or a watchband. More particularly, the present invention relates to a link assembly having links that are easily attached or removed with minimal force to lengthen or shorten a band.

BACKGROUND OF THE INVENTION

Bands for bracelets and watches are often composed of individual segments to adapt the band to a wearer's wrist. These segments are typically joined using screw fittings that pivotably attach the links together; however, this configuration has numerous disadvantages. For example, when the wearer desires to lengthen or shorten the band, the wearer oftentimes must purchase special tools or hire a jeweler. Furthermore, it is common for the band to come apart as these screws tend to loosen and separate.

Various other band designs use close tolerances to lock segments together by using a pin to prevent the band from separating. These close tolerances often require large forces to remove the pin during assembly and/or disassembly—sometimes resulting in damage or destruction to these fragile pieces.

The present invention is designed to overcome these disadvantages by providing a link assembly allowing users to easily lengthen or shorten a band without applying large forces or using special tools.

SUMMARY OF THE INVENTION

The present invention provides an adjustable band link assembly containing multiple connected segments that can be easily removed or added to adjust the length of the band. Adjustment can be performed in minimal time and without complex or costly tools.

The band link assembly contains a first segment and a second segment that are pivotally attached by a connecting pin. Each segment contains an extension portion and a receiver portion where the extension portion on the first segment is connected to the receiver portion on the second segment by the pin. The extension portion protrudes outwardly from the segment body and includes a transverse opening extending across the extension width. The receiver portion includes two parallel arms that form a receiving area to allow the extension from the first segment to be inserted therein. Each arm contains a transverse opening that is in co-axial alignment with the other arm opening so that as the extension portion is inserted inside the receiving area, the extension portion transverse opening can be coaxially aligned with the arm openings to receive the connecting pin.

The extension portion transverse opening supports a cylindrical spring tube having a hollow interior to receive and lock the connecting pin in position. The pin is locked relative to the extension opening by a locking mechanism defined by at least one detent and preferably two detents protruding inside the spring tube hollow interior to engage with an annular groove on the connecting pin. The spring tube contains an opening or slot extending along its longitudinal length to allow added flexibility when the connecting pin is inserted inside the spring tube interior. The connecting pin is appropriately sized to extend through the aligned extension portion and arm openings to pivotably attach the segments together.

The band size is adjusted by removing the pin to separate the first and second segments. Removal is accomplished by inserting a push-pin, a pin having approximately the same diameter as the installed connecting pin, inside the arm opening and exerting a force on the connecting pin to overcome the locking force between the annular groove and the spring tube detents. Once the spring tube detents are separated from inside the annular groove, the pin can be manually pulled from the extension and arm openings to disconnect the segments. Segments are detached from the band by removing the other connecting pin located on either the first or second segment and repeating the above described process. When lengthening the band, an additional segment is placed adjacent an unattached end of the first or second segment with the openings aligned so that the connecting pin can be inserted and locked in position by the spring tube. Once the band is at the desired length, the unattached segment ends are aligned and joined by the connecting pin to pivotably connect the segments.

The configuration of the present invention allows the user to adjust the band in minimal time and without the use of tools.

BRIEF DESCRIPTION OF THE DRAWINGS

For a more complete understanding of the invention and for further advantages thereof, reference is now made to the following Description of the Preferred Embodiments taken in conjunction with the accompanying Drawings in which.

DESCRIPTION OF THE PREFERRED EMBODIMENTS

The preferred embodiment of the link assembly herein is specially adapted for use on bands. It will be understood and appreciated by those of ordinary skill in the art, however, that the link assembly is suitable for various types of jewelry such as bracelets and watchbands, for example.

Figure 1:
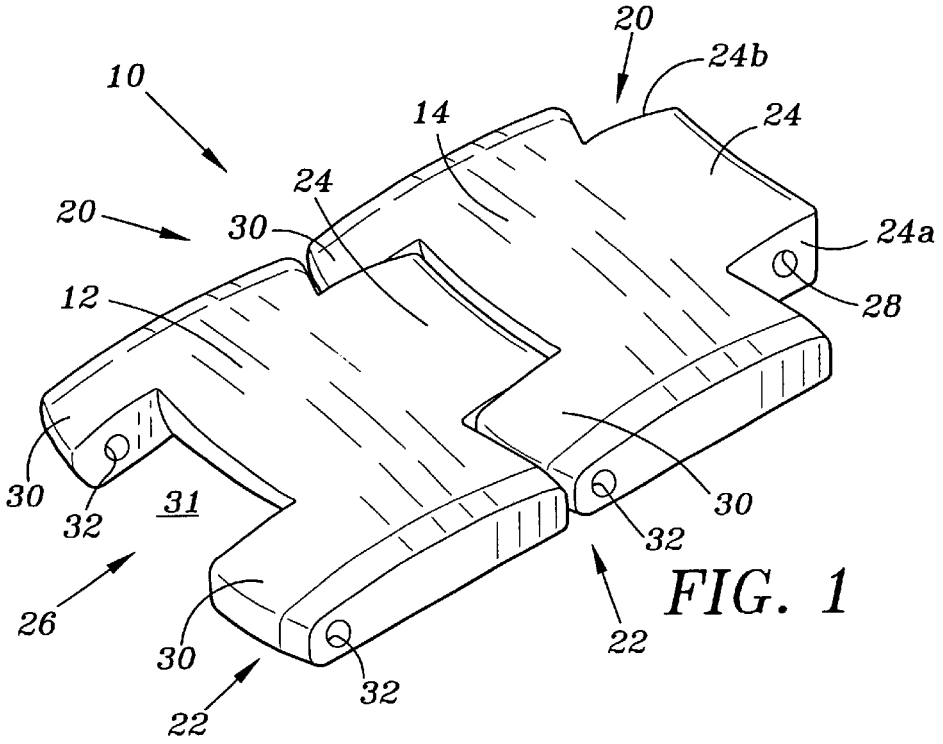
FIG. 1 is a perspective view of the present band link assembly showing a first segment attached to a second segment.
Figure 2:
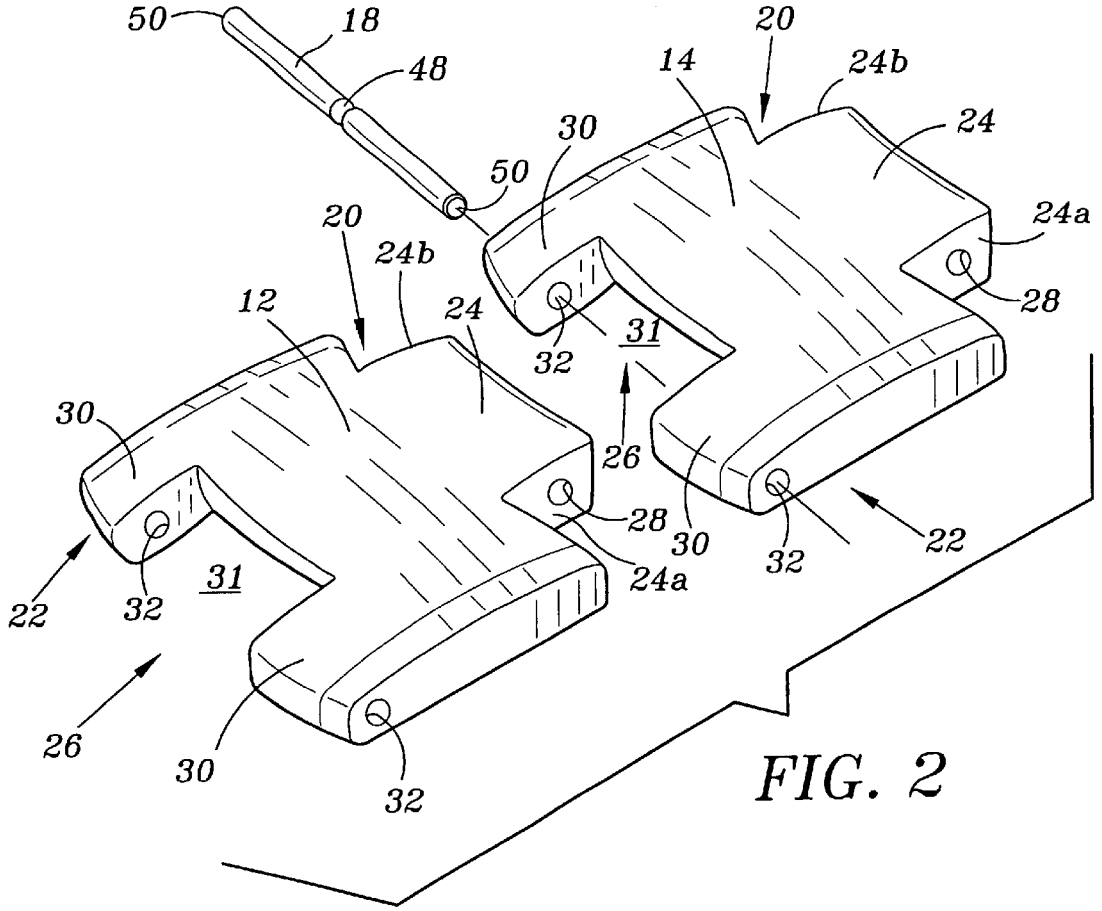
FIG. 2 is an exploded perspective view of the band link assembly illustrated in FIG. 1.
Figure 3:
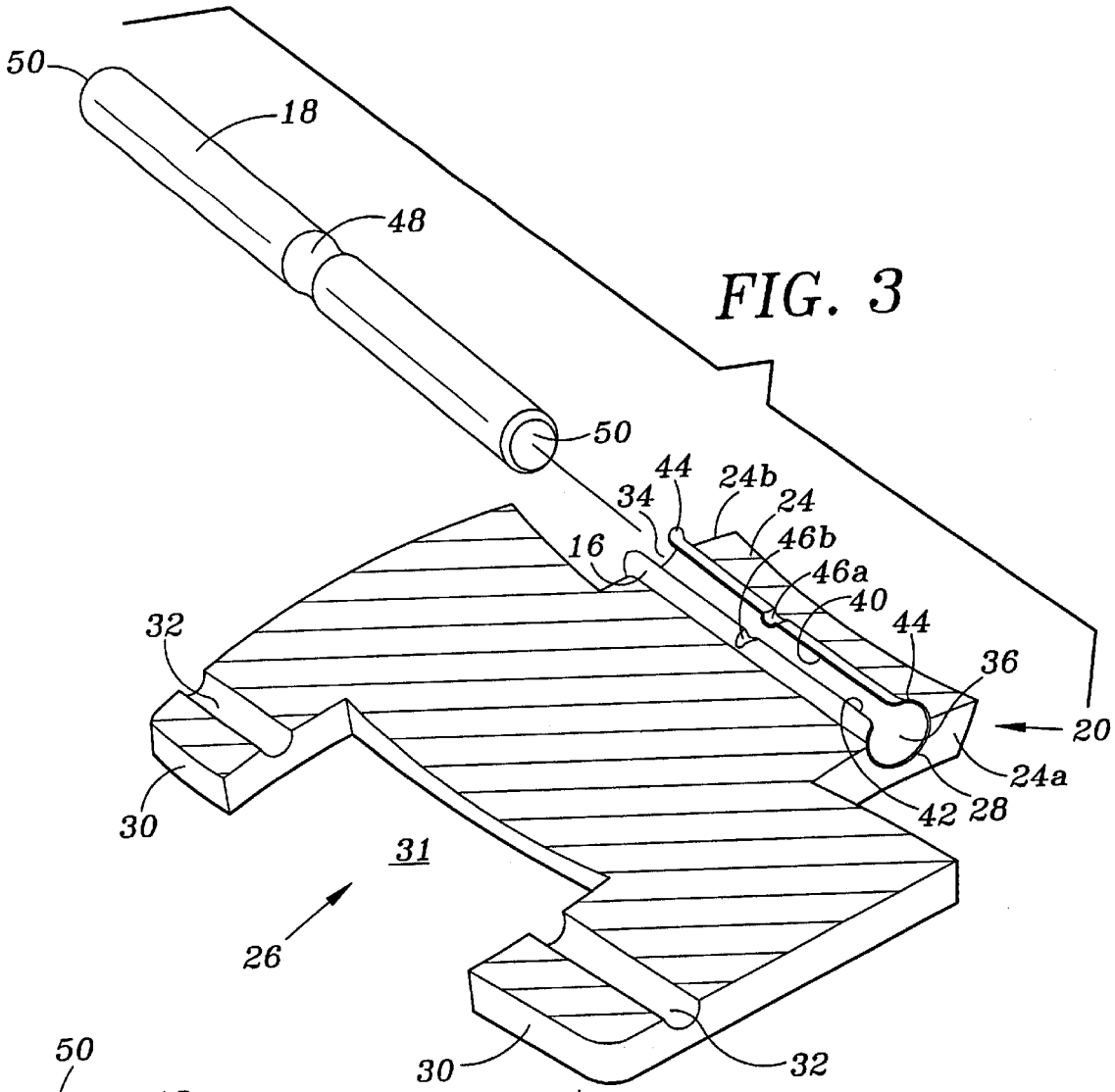
FIG. 3 is an exploded cross-sectional view of a segment illustrating a spring tube mounted inside a transverse opening and a connecting pin adjacent the spring tube.

Referring to FIGS. 1–3, the present link assembly 10 includes a first segment 12, a second segment 14, a spring tube 16 (FIG. 3) and a connecting pin 18, together forming a portion of a band. Each segment 12 or 14 includes a front-end 20 and a rear-end 22. Front-end 20 contains an extension 24 having sides 24*a* and 24*b* and rear-end 22 includes a receiver portion 26. An opening 28, located on extension 24, extends through the entire width of extension 24. Receiver portion 26 includes two parallel extension arms 30 that define receiving area 31 therebetween. Each arm 30 contains an opening 32 extending through the entire arm 30 and in co-axial alignment with opposite arm opening 32.

Figure 4:
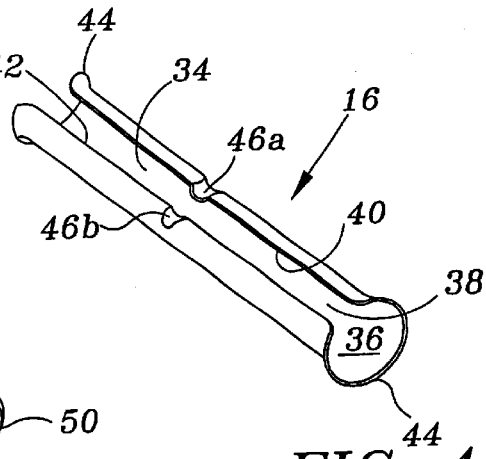
FIG. 4 is a perspective view of the spring tube showing two detents extending inside the interior of the spring tube.

Referring to FIG. 4, spring tube 16 is generally cylindrically shaped and has a hollow interior 34 defined by inner surface 36. A longitudinal opening or slot 38 is formed by first edge 40 and second edge 42 extending along the entire length of tube 16. As seen in FIG. 3, spring tube 16 fits inside opening 28 and is designed so that a small clearance exists between tube 16 and opening 28. This clearance permits slot 38 to expand or contract in response to forces applied to spring inner surface 36 when pin 18 is inserted into hollow interior 34, as discussed in more detail below. Spring tube 16 is slightly longer than the width of extension 24 to allow flared ends 44 of tube 16 to curve outward and adjacent extension side boundary 24*a* and 24*b* to support spring tube 16 inside opening 28. Spring tube 16 further preferably includes "u" shaped detents 46*a* and 46*b* located adjacent first edge 40 and second edge 42 extending into hollow interior 34. It is understood by those skilled in the art that other detent configurations can be used, including, but not limited to having only one detent on either edge 40 or 42 or having one continuous detent extending circumferentially around the tube from edge 40 to edge 42 (not shown).

Figure 5:
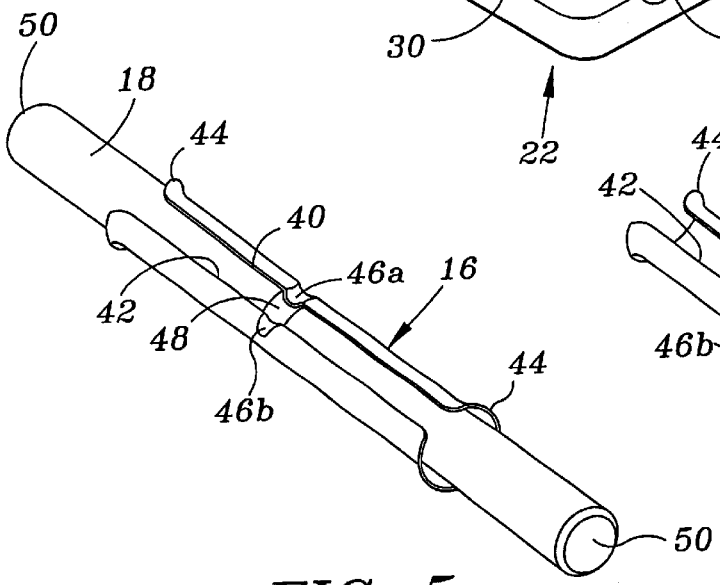
FIG. 5 is a perspective view of the connecting pin mounted inside the spring tube.

Connecting pin 18 is most preferably cylindrically shaped and fits inside hollow interior 34 of spring tube 16. Connecting pin 18 contains an annular groove 48 preferably having a "u" shaped cross-section to receive detents 46*a* and 46*b*. It is understood, however, that the disclosed shapes can be modified so that detents 46*a* and 46*b* and groove 48 may have a "v" shaped cross-section, for example. As seen in FIG. 5, pin 18 is mounted inside spring tube 16 so that annular groove 48 aligns with detents 46*a* and 46*b*. While in this configuration, detents 46*a* and 46*b* hold pin 18 in fixed relation to tube 16 and is released by applying a slight force to pin 18 in the axial direction.

As pin 18 is inserted inside spring tube 16, the pin is pushed toward detents 46*a* and 46*b*. Upon reaching detents 46*a* and 46*b*, a tapered portion 50 at the ends of tube 16 act on the detents to cause outward movement of first edges 40 and 42. This action creates an enlarged longitudinal slot 38 to allow proper clearance for pin 18 to be further inserted. Pin 18 is pushed further until detents 46*a* and 46*b* mate with annular groove 48, as best seen in FIG. 5. As detents 46*a* and 46*b* engage groove 48, spring tube 16 contracts and edges 40 and 42 return to their original position thereby locking connecting pin 18 in position.

The addition of extra segments 12 or 14 is easily performed with minimal force and taking minimum time. As seen in FIGS. 1 and 2, extension 24 is inserted between parallel arms 30 so that openings 28 and 32 are co-axially aligned. Once aligned, connecting pin 18 is inserted through openings 28 and 32 to pivotably join first segment 12 with second segment 14. Pin 18 is pushed until annular groove 48 aligns with detents 46*a* and 46*b* on spring tube 16 to lock pin 18 inside openings 28 and 32. While in this position, pin 18 extends approximately the entire width of the band formed when first segment 12 is connected to second segment 14.

A push-pin (not shown), having approximately the same diameter as pin 18, is used to separate first segment 12 from second segment 14. The push-pin can be a specially fabricated item for disassembling the link assembly; however, other existing devices may be used such as paper clip ends, hair pins, tooth picks, etc. The push-pin is co-axially aligned with pin 18 to provide a slight axial force on pin 18 to overcome the locking force resulting from detents 46*a* and 46*b* engaging with annular groove 48. Once pin 18 is moved from the locked position, pin 18 can be manually pulled from opening 32 with minimal force. Segments are permanently detached from the band by removing the other connecting pin located on either first segment 12 or second segment 14 and repeating the above described process. When lengthening the band, an additional segment (not shown) is placed adjacent an unattached end of first segment 12 or second segment 14 with extension opening 28 aligned with arm openings 32 so that the connecting pin can be inserted and locked in position by the spring tube. Once the band is at the desired length, the unattached segment ends are aligned and connecting pin 18 is re-inserted inside openings 28 and 32 to pivotably connect the segments.

Spring tube 16 and connecting pin 18 are most preferably fabricated from a metal such as stainless steel. However, it should be understood that tube 16 and pin 18 can be of any suitable material having a sufficient rigidity, such as plastic, for example.

Although the preferred embodiments of the present invention have been illustrated in the accompanying drawings and described in the foregoing Description of the Preferred Embodiments, it will be understood that the invention is not limited to the embodiments disclosed but is capable of numerous rearrangements, modifications, and substitutions of parts and elements without departing from the spirit of the invention.

I claim:

1. A link assembly for linking two segments of a band, the link assembly comprising:

a first segment having an extension portion and a receiver portion, said extension portion having a transverse opening extending therethrough, said receiver portion having two spaced apart parallel arms, each of said arms including a transverse opening extending therethrough such that said arm openings are disposed in co-axial alignment with one another;

a second segment having an extension portion and a receiver portion, said extension portion having a transverse opening extending therethrough, said receiver portion having two spaced apart parallel arms, each of said arms including a transverse opening extending therethrough such that said arm openings are disposed in co-axial alignment with one another;

a spring tube disposed within said extension portion opening, said spring tube having a longitudinal length, a hollow interior and a slot extending along said longitudinal length thereof, said slot defined by spaced apart first and second edges to allow expansion and contraction of said tube within said extension portion opening;

said first edge of said spring tube slot including a detent protruding inside said hollow interior;

said first segment extension portion being adapted to be inserted between said arms of said second segment so that said extension portion transverse opening is co-axially aligned with said parallel arm transverse apertures; and a pin adapted for insertion into said aligned extension portion and arm apertures to thereby pivotably join said first and second segments, wherein said pin is held in a fixed relation to said extension portion and arms by said spring tube.

2. The link assembly of claim 1, wherein said second edge contains a detent protruding inside said hollow interior.

3. The link assembly of claim 1, wherein said detent extends circumferentially around said spring tube from said first edge to said second edge.

4. The link assembly of claim 1, wherein said spring tube contains enlarged ends to maintain said spring tube inside said extension transverse opening.

5. The link assembly of claim 1, wherein said pin contains an annular groove to engage said detent thereby locking said pin inside said spring tube.

6. The link assembly of claim 5, wherein said spring tube slot expands in response to forces exerted by said pin as said pin is pushed inside the extension portion opening so that said annular groove can engage said detent to lock said pin inside said spring tube.

7. The link assembly of claim 1, wherein said pin is metal.

8. The link assembly of claim 1, wherein said pin is plastic.

9. The link assembly of claim 1 wherein said spring tube is metal.

10. The link assembly of claim 1, wherein said spring tube is plastic.

11. The link assembly of claim 1, wherein said first and second segments form a portion of a watchband.

12. The link assembly of claim 1, wherein said first and second segments form a portion of a bracelet.

13. A locking device for linking a first and second segment of a band, the locking device comprising:

a spring tube disposed within the first segments of the band, said spring tube having a longitudinal length, a hollow interior and a slot extending along the longitudinal length wherein said slot is defined by spaced apart first and second edges to allow expansion and contraction of said spring tube, said first edge contains a detent protruding inside said hollow interior; and a connecting pin adapted for insertion into said spring tube hollow interior to pivotably connect the second segment of the band to the first segment, said connecting pin having an annular groove to engage said detent to prevent said pin from moving relative to the spring tube.

14. The locking device of claim 13, wherein said spring tube contains enlarged ends.

15. The locking device of claim 13, wherein said spring tube is metal.

16. The locking device of claim 13, wherein said spring tube is plastic.

17. The locking device of claim 13, wherein said second edge contains a detent protruding inside said hollow interior.

18. The link assembly of claim 13, wherein said detent extends circumferentially around said spring tube from said first edge to said second edge.

* * * * *